United States Patent [19]

Tamaru et al.

[11] 3,992,868

[45] Nov. 23, 1976

[54] TIMEPIECE WITH CALENDAR MECHANISM

[75] Inventors: Munetaka Tamaru, Tokyo; Kazunari Kume; Minoru Watanabe, both of Tokorozawa; Hideshi Oono; Hideo Sato, both of Sayama, all of Japan

[73] Assignee: Citizen Watch Co., Ltd., Tokyo, Japan

[22] Filed: Feb. 27, 1975

[21] Appl. No.: 553,624

[30] Foreign Application Priority Data

Mar. 5, 1974 Japan ..... 49-25466

[52] U.S. Cl. ..... 58/5; 58/23 BA; 58/58

[51] Int. Cl.[2] ..... G04B 19/24; G04C 3/00

[58] Field of Search ..... 58/4 A, 23 R, 23 BA, 58/23 D, 5, 58; 318/313

[56] References Cited

UNITED STATES PATENTS 3,855,781 12/1974 Chihara ..... 58/23 D

*Primary Examiner*—Edith Simmons Jackmon

*Attorney, Agent, or Firm*—Sherman & Shalloway

[57] ABSTRACT

An electronic timepiece having a calendar mechanism for displaying a date or date and day includes circuitry for detecting the timing or the movement of the calendar mechanism and for generating a detecting signal. The timepiece also includes means for controlling the electric power supplied to energizing means for the calendar mechanism when the detecting signal is supplied.

5 Claims, 7 Drawing Figures

TIMEPIECE WITH CALENDAR MECHANISM

BACKGROUND OF THE INVENTION

This invention relates to an electronic timepiece with a calendar mechanism which is improved by preventing a decrease in the accuracy of the subject timepiece at the time of operation of the calendar mechanism.

In the timepieces with a calendar mechanism power for energizing the calendar mechanism is great in comparison with the power used to energize the timepiece movement. In the case of a completely balanced timepiece, this causes a decrease in accuracy due to the reduction in the amplitude of available power when using a step-motor drive, the deviation from the normal position of the rotor, results frequently in the movement. Such tendencies will increase in those timepieces having the function of displaying both day and month or having a quick or early operation of the calendar display.

SUMMARY OF THE INVENTION

An object of this invention is to provide an electronic timepiece having a calandar mechanism which is so improved that the timepiece movement is subjected to substantially no influences due to the operation of the calendar mechanism.

An electronic timepiece according to this invention essentially comprises means for detecting the operation of the calendar mechanism and means for controlling the electric power supplied to the calendar mechanism when the signal from the detecting means is supplied thereto. The detecting means can operate to generate a signal by detecting the timing of the start of the calendar mechanism or by sensing that the power for energizing the calendar mechanism reaches a predetermined value.

Other objects and advantages of this invention will be more fully understood from the following description taken in connection with the accompanying drawings.

DETAILED DESCRIPTION OF THE PREFERRED EMBODIMENT

Figure 2:
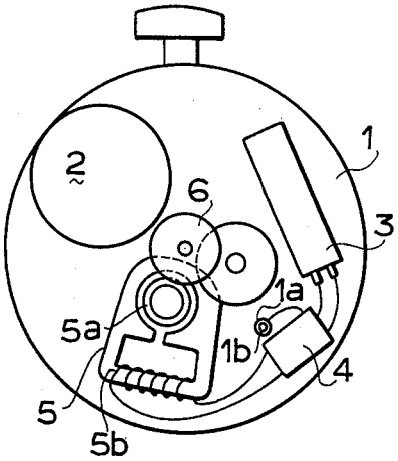
FIG. 2 is a schematic rear view of the timepiece shown in FIG. 1.
Figure 1:
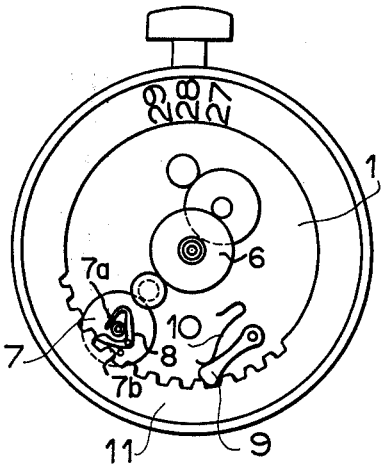
FIG. 1 is a schematic front view of a timepiece embodying this invention.

As seen in FIGS. 1 and 2, a timepiece includes the following elements: a substrate 1, an electric battery cell 2, a crystal oscillator 3, an IC circuit block 4 including oscillating, frequency dividing and dividing circuits and an electric-mechanical transducer 5 having a rotor 5*a* and a coil 5*b*. A second wheel 6 is driven by the rotor 5*a* via a gear train to rotate one revolution every minute and a calendar wheel 7 is driven by the second wheel 6 through a gear train to rotate one revolution by 24 hours. A lever 9 biased by a spring 10 serves as a detent to retain the position a calendar plate 11.

Figure 3:
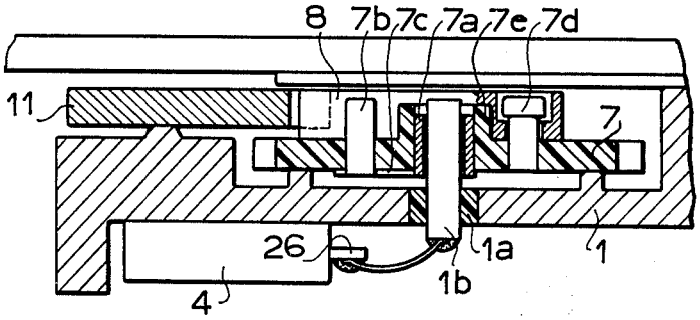
FIG. 3 is a partial section of the timepiece shown in FIGS. 1 and 2.
Figure 4:
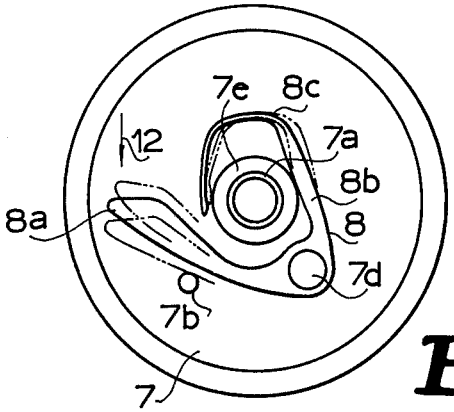
FIG. 4 is a plan view of a calendar wheel, in enlarged scale, used in the timepiece shown in FIGS. 1 to 3.

As shown in FIGS. 3 and 4, a shaft 1*b* is journaled on the substrate 1 within an insulating bushing 1*a* to electrically isolate the shaft and substrate. The calendar wheel 7 is made of an insulating material such as plastic and is supported on the shaft 1*b* with a metal bushing 7*a*. A switch shaft 7*b* projects from the calendar wheel 7 and connects with the bushing 7*a* via a lead plate 7*c*. A spring lever 8 having a driving pawl 8*a* and two spring arms 8*b* and 8*c* is supported rotatably on the calendar wheel 7 and held by a rivet 7*d*.

In the normal state, the spring lever 8 is positioned so that the arms 8*b* and 8*c* surround a boss 7*e* of the calendar wheel 7, as shown by the solid line in FIG. 4. When the pawl 8*a* is subjected to a driving force acting in the direction shown by an arrow 12, the arm 8*b* is resiliently deformed and when the force increases over a predetermined, amount the arm 8*b* is more deformed and contacts the switch shaft 7*b*.

On the other hand, when the pawl 8*a* is pressed in the opposite direction of the arrow 12 at the time, for example, of quick revolution of the calendar plate 11, the other arm 8*c* is deformed as shown by the two dotted chain in FIG. 4.

The pawl 8*a* of the spring lever 8 acts to rotate the calendar plate 11 against the detent action of the lever 9 and, in this stage, if the load or torque is acting to the spring lever 8, then the pawl 8*a* contacts the switch shaft 7*b* due to deformation of the arm 8*b*. Accordingly, if the substrate is connected to the plus terminal of a direct current source of supply, a plus signal will be sent to the circuit block 4 through a path consisting of the calendar plate 11, spring lever 8, switch shaft 7*b*, lead plate 7*c*, metal bushing 7*a* and shaft 1*b*. The pawl 8*a* will disconnect from the shaft 7*b* when the load decreases. The limit of the load is determined by the resiliency of the arm 8*b* and, if necessary, a suitable adjustment may be made. One of the applicable adjustment is to use as the shaft 7*b* a member having an eccentric head which acts to rotate the spring lever 8. When one wishes to obtain an operation so that a signal is supplied to the circuit 4 when the calendar mechanism starts to operate regardless of the size of the load, the spring lever 8 is insulated from the members other than the substrate 1 so as to obtain a signal only when the pawl 8*a* contacts the calendar plate 11.

Electrical energy for use in operation of the calendar mechanism to change the indication relating to date, day or month is supplied from a direct current source of supply to the transducer 5 under the control of controlling means after the circuit 4 is supplied with a signal in the manner as described above.

Figure 5:
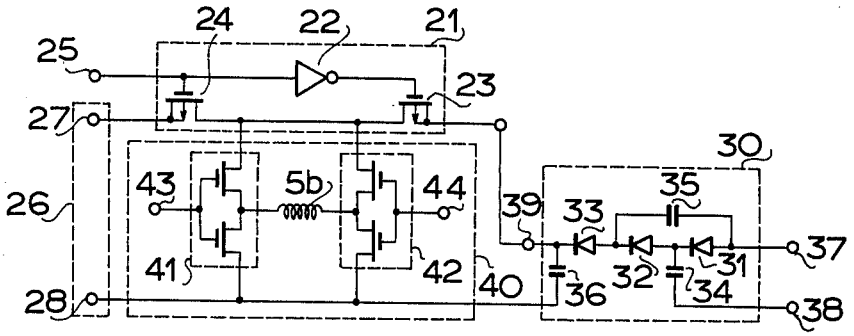
FIG. 5 is an electric circuit diagram of a circuit used in the timepiece of this invention.

One of the suitable controlling means is shown in FIG. 5, in which a detector 21 utilizes an inverter 22 and two MOSTS (Metal-Oxide-Semiconductor Transistors) 23 and 24. The detecting signal of the detector is kept H during the operation of the calendar mechanism and the detector is supplied by a pair of input terminals 25. When the level of the signal is L or when the calendar mechanism is out of operation, the first MOST 23 is maintained OFF and the second MOST 24 is held ON. On the other hand, when the level of the signal is H, the first MOST 23 is turned on and the second MOST 24 turned OFF.

The reference numeral 26 denotes a direct current source of supply having a plus terminal 27 and a minus or ground terminal 28. A booster 30 comprises three diodes 31, 32, and 33 and three condensers 34, 35 and 36. A signal having a higher frequency than the driving cycle of the transducer 5 is supplied to a pair of terminals 37 and 38 in reverse phase to the driving cycle.

When the level at the terminal 38 becomes H, the first condenser 34 is charged and when the level at the other terminal 37 becomes H due to the inversion in phase, the second condenser 35 is charged at the voltage twice the terminal voltage of the first condenser 34. Accordingly, the potential at the terminal 39 becomes twice the voltage of the source.

A driving circuit denoted by the reference numeral 40 comprises a pair of CMOST (Complementary Metal-Oxide Semi-conductor Transistor) 41 and 42 having gates that are alternately energized once per second by the signal supplied from the frequency divider through terminals 43 and 44, respectively.

When the level at the terminal 25 is L, the coil **5*b* of the driving circuit 40 is driven at the voltage impressed between the terminals 27 and 28 which is equal to that of the source and when the level is H, or when the calendar mechanism is in operation, the driving circuit 40** is driven at the voltage twice the voltage of the source.

Figure 6:
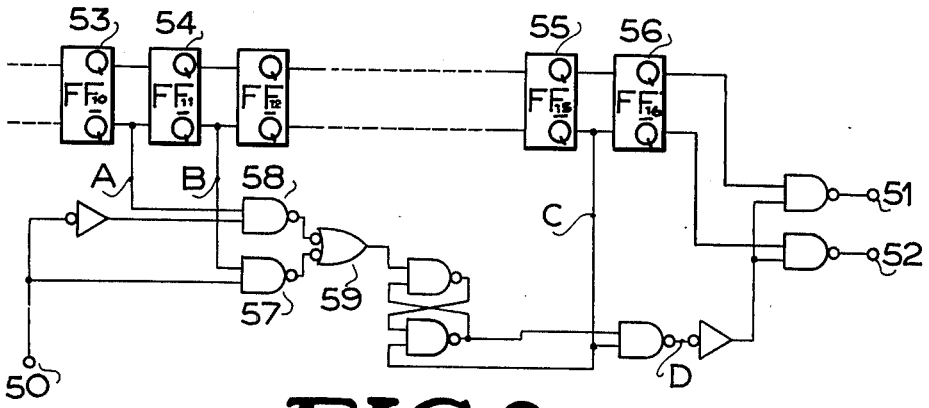
FIG. 6 is a block diagram of an alternative circuit used in the timepiece of this invention.

In FIG. 6 there is shown a modified controlling means which functions to elongate the width of driving pulses. The level at a terminal 50 which corresponds to the terminal 26 in FIG. 5 is kept at L and rises to H when the calendar mechanism is in operation. From output terminals denoted by 51 and 52 signals are generated which have levels that are mutually changed by two seconds. A series of flip-flop circuits 53 through 56 constitute a frequency divider. With a standard oscillator having an oscillator frequency of 32,768 KHz, the flip-flop 53 forming the 10th step generates a signal having a frequency of 32 Hz; the flip-flop 54 forms an 11th step generating a 16 Hz signal, the flip-flop 55 15th step generating 1 Hz signal and the flip-flop 56 16th step generating 0.5 Hz signal. The reference numeral 57 designates a first NAND gate for the terminal 50 and 16 Hz pulse train, 58 a second NAND gate for the terminal 50 and 32 Hz pulse trains and 59 a NOR gate for the first and second NAND gates.

Figure 7:
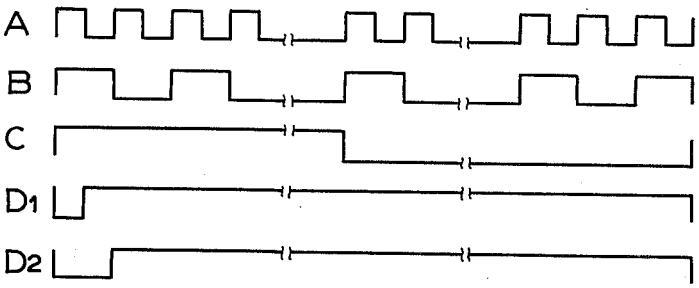
FIG. 7 is a diagram showing how the circuit of FIG. 7 modifies pulses.

Typical wave forms of the signals in the circuit of FIG. 6 are given in FIG. 7 wherein the letters A, B, C, D1 and D2 corresponding to the points shown in the same letters. When the level at the terminal 50 is kept at L (when the calendar mechanism is out of operation), the output of the NAND gate 58 is maintained L level and the following elements are controlled by the output of the first NAND gate 57. Accordingly, a pulse train having a duration of 1/64 second as shown by D1 in FIG. 7 is obtained from the terminals 51 and 52.

When the level at the terminal 50 is H (when the calendar mechanism is in operation), the output of the first NAND gate 57 becomes level L and the other elements are placed under the control of the second NAND gate 58, so that a pulse train having a duty of 1/32 second as shown by D2 in FIG. 7 is taken from the terminals 51 and 52.

The duration of the pulses is determined in accordance with the step of the frequency divider from which the signal is obtained, so that a driving pulse train having a desired wave form can be obtained by selecting the cycle depending on the condition of the calendar mechanism.

In the above embodiments, a pulse motor is used as an electric-mechanical transducer. However, another type of transducer such as a completely balanced motor or a driving mechanism used with a pallet fork and staff can be employed.

According to this invention, as has been stated hereinbefore, the electrical energy supplied to the calendar mechanism is increased when the power or load produced for driving the calendar mechanism increases over a predetermined value or when such a load is created, so that the undesirable effects incurred by driving the calendar mechanism, such as decreased accuracy of the timepiece movement will be eliminated. Accordingly, it is possible to introduce into a calendar mechanism a function displaying the date or month and a quick change of the function at midnight. In addition, the power consumption can be minimized since the increase in electrical energy is limited within the requisite period of time.

What is claimed is:

1. An electronic timepiece with a calendar mechanism including a calendar display, wherein the timepiece has an electrically driven movement powered by an electric current, the electrically driven movement including an electromechanical transducer for converting said electrical energy into torque for driving said calendar mechanism to change the display, said electronic timepiece characterized by:

a source of electrical energy;

a calendar gear wheel including in said calendar mechanism and driven to rotate by said electromechanical transducer;

a calendar feeding spring means disposed on said calendar gear wheel and driving said calendar display upon rotation of said calendar gear wheel;

means for mounting said spring means to deflect a predetermined amount in response to a predetermined torque on said calendar gear wheel;

a normally open electrical path;

means for closing temporarily said electrical path upon deflection of said spring means the predetermined amount to complete a circuit through said path, and to thereby generate a detection signal;

means for controlling the energy supplied to the transducer, said controlling means connected in said electrical path and to said electromechanical transducer between said electromechanical transducer and said source, wherein said means increases the amount of electrical energy delivered to said transducer by said source as long as said path is closed.

2. The electronic timepiece of claim 1, wherein:

said source of electrical energy includes means for generating a train of pulses;

said transducer drives said movement in response to said train of pulses;

and wherein;

said controlling means includes frequency divider means for increasing the width of the pulses when supplied with the detecting signal.

3. The electronic timepiece of claim 1, wherein the calendar feeding spring engages the calendar display directly, and wherein the calendar display is an internally toothed ring, which is indexed by said calendar feeding spring against the bias of detent means.

4. The electronic timepiece of claim 1, wherein said frequency divider means includes a plurality of cascaded stages, wherein prior to an after reception of said detection signal, the frequency divider pulses the transducer at a larger frequency than during reception of said signal.

5. An electronic timepiece with a calendar mechanism as claimed in claim 1 wherein said controlling means comprises a device for increasing the voltage impressed from said source to said transducer when supplied with said detecting signal.

* * * * *